United States Patent [19]

Grolla

[11] 3,970,139

[45] July 20, 1976

[54] VACUUM CONTROL VALVING APPARATUS FOR A VACUUM SEALED MOLDING APPARATUS

[75] Inventor: Herbert Grolla, Laasphe, Germany

[73] Assignee: Heinrich Wagner Maschinenfabrik, Laasphe, Westphalia, Germany

[22] Filed: Jan. 6, 1975

[21] Appl. No.: 538,794

[30] Foreign Application Priority Data

Jan. 22, 1974 Germany ..... 2402870

[52] U.S. Cl. ..... 164/253; 164/385

[51] Int. Cl.[2] ..... B22C 11/12; B22C 9/02

[58] Field of Search ..... 164/7, 160, 384, 385, 164/387, 388, 389, 390

[56] References Cited

UNITED STATES PATENTS

| | | | |
|---|---|---|---|
| 3,825,058 | 7/1974 | Miura et al. | 164/7 X |
| 3,832,117 | 8/1974 | Hijikata et al. | 164/7 X |
| 3,872,915 | 3/1975 | Nakata et al. | 164/160 |

*Primary Examiner*—Ronald J. Shore

*Attorney, Agent, or Firm*—Woodhams, Blanchard and Flynn

[57] ABSTRACT

A vacuum control valving apparatus for a vacuum sealed molding apparatus. The control valving apparatus is located between a pair of mold members, one stacked upon the other, and a mating surface on a rail conveyor truck. The valving apparatus provides a controlled communication of a first vacuum source to an evacuation chamber on the mold members. The valving arrangement also effects a connection of the evacuation chambers on each of the mold members to a second vacuum source connection of the rail conveyor truck when the mold members are vertically stacked one on the other and in the appropriate location on the rail conveyor truck.

10 Claims, 2 Drawing Figures

VACUUM CONTROL VALVING APPARATUS FOR A VACUUM SEALED MOLDING APPARATUS

FIELD OF THE INVENTION

The invention relates to a casting box for producing castings with the aid of sand containing no binder, the box or mold member consisting of frame-like upper and lower boxes or mold members, each of which is provided with an evacuation pipe.

BACKGROUND OF THE INVENTION

The use of lost patterns consisting of films is known from German OS No. 1 926 163. These patterns can be produced in a simple manner by a known deep-drawing shaping process utilizing reduced or elevated pressure. The patterns are introduced into a casting box, whereupon the latter is filled with loose binderless sand. The sand is thereupon subjected to reduced pressure, so that the film of the pattern is pressed against the sand by the external air pressure. In this way it is possible to produce patterns of stable shape from very thin films. This stability of shape is however ensured in the case of thin films only as long as the reduced pressure is maintained in the sand. This method of casting has been found decidedly advantageous because the production of the castings entails only little expense, a casting having a very smooth surface is obtained, and the preparation of the sand is not necessary.

A prerequisite for the performance of the process described above is that the reduced pressure in the upper and lower parts of a two-part casting box should be maintained from the time when the pattern is completed until the casting has been completely cooled. In order to obtain a continuous work flow it is known to place the casting box on trucks of a closed-circuit rail conveyor. The length of the rail conveyor and the cycle time for the movement of the rail conveyor truck are so selected that after one circuit of the casting box the casting has cooled to such an extent that it can be removed from the casting box. If it is desired to achieve high cycle times, a long rail conveyor must be selected, because the cooling times are dictated. In long rail conveyors, however, the suction pipes connected to the upper and lower boxes are a distinct disadvantage. Known rail conveyors are circular in shape and have a central suction pipe from which flexible pipes lead to the individual casting boxes. These known rail conveyors make poor use of the available space, and in addition, because of the supply pipes, they cannot be indefinitely enlarged. Another disadvantage of these known rail conveyors is that manipulation of the casting boxes is limited by their continuous connection to the central suction pipe.

The problem underlying the invention consists in so constructing a casting box of the kind first described above that during the casting and cooling time the connection of the upper and lower boxes to flexible suction pipes is not necessary and that rail conveyors of any desired length can be used.

According to the invention this problem is solved through the fact that each of the evacuation pipes disposed in the upper and lower boxes can be connected to a suction pipe by way of a coupling closed by a valve, that the upper and lower boxes each have another coupling which is closed by a valve and by which a connection can be made between the suction pipe of the two boxes when the upper box is placed on the lower box, and that the lower box contains an additional coupling which is closed by a valve and by means of which the lower box, and consequently also the upper box placed on the lower box, can be connected to another suction pipe, which is for example installed in a rail conveyor truck.

The upper and lower boxes thus each have available a coupling to which suction pipes can be connected temporarily during the forming of the pattern. These couplings are necessary because the upper and lower boxes are made separately. When the upper and lower boxes are placed one on top of the other the evacuation pipes of the two boxes are connected together. It would at this point be conceivable that one of the two suction pipes could be removed. When the lower box is placed on the rail conveyor truck, it is connected by means of another coupling to the suction pipe of the rail conveyor truck. The lower and upper boxes are now evacuated with the aid of the suction pipe of the rail conveyor truck, whereupon the two suction pipes acting on the upper and lower boxes can be removed. Suction pipes leading to the upper and lower boxes are now no longer necessary. The suction pipes of the individual rail conveyor trucks can be connected together, so that rail conveyors of any length can be formed. The suction pipes of the rail conveyor trucks need then only be connected at one point to a central suction pipe. According to the invention each of the couplings of the casting box is provided with a nonreturn valve, so that on the removal of a suction pipe or on the lifting-off of the upper box or lower box the coupling freed is automatically closed.

In a preferred embodiment of the invention the coupling connecting the upper box to the lower box is in the form of a pin and a bore, the pin disposed on one box engaging a bore provided on the other box. Furthermore, according to the invention the coupling connecting the lower box to the rail conveyor truck is made in the form of a pin and a bore, the pin or bore being provided either on the lower box or on the rail conveyor truck.

In another advantageous embodiment, the bores are disposed in the lower box and the pins in the upper box and rail conveyor truck respectively. According to the invention, nonreturn valves consisting of a spring-loaded ball are provided in the pins. According to another proposal of the invention the sockets provided in the lower parts are disposed in line with and opposite one another and are closed by respective valve cones loaded by a common spring. This valve cone is provided on its end face with a push-rod which opens the nonreturn valve provided in the pin when the upper box is placed on the lower box or when the lower box is placed on the rail conveyor truck.

BRIEF DESCRIPTION OF THE DRAWINGS

The invention will now be described, by way of example, with reference to the accompanying drawing, in which.

DETAILED DESCRIPTION

Figure 1:
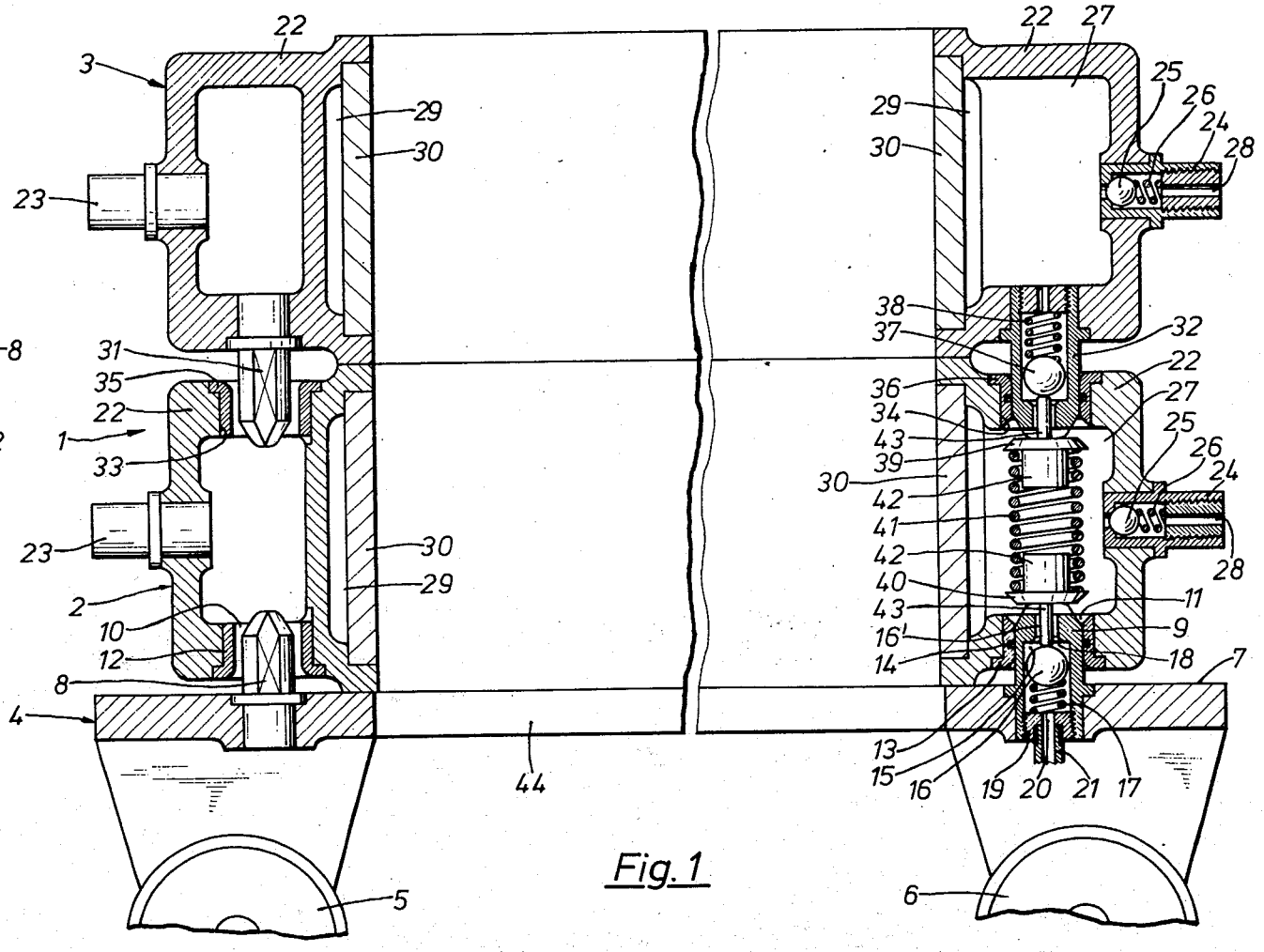
FIG. 1 is a section through a casting box according to the invention.

Referring to the drawing, the casting box 1 is composed of a lower box or mold member 2 and an upper box or mold member 3. The casting box 1 rests on a rail conveyor truck 4, whose wheels are designated 5 and 6.

Figure 2:
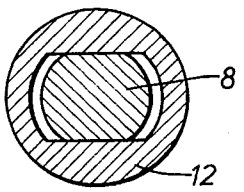
FIG. 2 is a section through a fastening pin of the casting box.

The support surface 7 of the rail conveyor truck 4 is provided with pins 8,9 which serve to fasten the lower box 2 on the rail conveyor truck. The pins 8,9 engage in bores 10,11 in the lower box 2. The bore 10 contains an inserted bushing 12 which in one direction enables the lower box 2 to be moved relative to the pin 8, as shown in FIG. 2. A bushing 13 inserted in the bore 11 matches the pin 9 and is sealed in relation to the latter by means of a seal 14.

The pin 9 has two cylindrical bores 16',15, of different diameters. The bore 15 receives a ball 16 which is loaded by a spring 17 and is pressed by the latter against a seat 18 in the smaller bore 16'. The other end of the spring 17 is supported against a nut 19 screwed into the bore 15. The nut 19 has a central bore 20 and is provided with an internal screwthread into which is screwed a suction pipe 21 connected to the rail conveyor truck 4. The suction pipe 21 is continuously evacuated. In the periods of time during which no casting box is placed on the rail conveyor truck 4, the suction pipe 21 is closed by the nonreturn valve consisting of the spring 17, ball 16 and seat 18.

The lower box 2 and the upper box 3 have the same external dimensions. They each consist of a frame-like box 22, which has two carrying attachments 23,24, one on each side. For the transport of the casting boxes, grippers act on the carrying attachments. The carrying attachment 24 is provided with a nonreturn valve consisting of a ball 25 and a spring 26. When the gripper is not connected, the nonreturn valve seals on the evacuation chamber 27, which is disposed in the casting box, in relation to the atmosphere. The gripper acting on the carrying attachment 24 is provided with a suction pipe. When the gripper is coupled to the carrying attachment 24, the suction pipe of the gripper is also connected to a suction pipe 28 formed in the carrying attachment 24. The spring 26 of the nonreturn valve is so dimensioned that the evacuation chamber 27 can be evacuated through the gripper.

The evacuation chamber 27 is connected to an annular space 29 which is closed in relation to the inside of the casting box by means of a porous heat-resistant wall 30. The casting box 1 can be evacuated through the evacuation chamber 27, the annular chamber 29, and the wall 30.

The lower face of the upper box 3 is provided with pins 31,32 which engage in bores 33,34 provided on the upper face of the lower box. Bushings 35,36 are inserted in the bores 33,34. The pin 31 and the bushing 35 correspond in construction to the pin 8 and the bushing 12. The pin 32 and the bushing 36 correspond to the pin 9 and the bushing 13. A ball 37 and a spring 38 are disposed in the interior of the pin 32, and also in the pin 9. The function of the pin 32 corresponds to that of the pin 9.

In the evacuation chamber 27 of the lower box 2 are disposed two frusto-conical valves 39,40 which are pressed against the bushings 36 and 13 by a common spring 41. Each valve 39,40 has an attachment 42, which serves to guide the spring 41. On the outer surface of each valve 3,40 is formed a pushrod 43 which presses against the ball 16 or 37 when the upper box 3 is placed in position or when the lower box is placed on the rail conveyor truck 4, thus establishing communication between the evacuation chambers 27 of the lower and upper boxes and the suction pipe 21 in the rail conveyor truck.

The work cycle for the production of a casting is as follows. The two half-patterns are first made in the upper box and the lower box. For this purpose, separately for the upper box and the lower box, a film is first laid on a mask made to match the pattern and by suction and heat is shaped to correspond thereto. The mask together with the film situated on it is thereupon inserted into the casting box 2 and 3 respectively, whereupon sand is filled into the casting box. The film is then laid on the upper face of the casting box, including the ingate. Through the application of a vacuum to the evacuation chamber 27 the interior of the casting box is evacuated, so that because of the external air pressure the films are pressed against the sand. The mask is then removed from the casting box. The evacuation of the two halves of the casting box, which up to this time have been separated from one another, is effected through the suction pipe 28, with the aid of a gripper connected to the supporting attachments 24.

On completion of the lower box the latter is placed on the rail conveyor truck 4, the pins 8 and 9 being pushed into the bushings 12 and 13. The evacuation chamber 27 of the lower box 2 is thereby connected to the suction pipe 21 of the rail conveyor truck. The gripper acting on the supporting attachment 24 can now be removed, since the reduced pressure in the lower box 2 is maintained by the suction pipe 21 of the rail conveyor truck. At this moment the bushing 36 is still closed by the valve 39. The upper box is then placed on the lower box. The pins 31 and 32 engage the bushings 35 and 36. The valve 39 is lowered slightly, and at the same time the push-rod 43 of the valve 39 presses against the ball 37 and raises the latter, so that communication is established between the evacuation chamber 27 of the upper box 3 and the evacuation chamber 27 of the lower box 2. The upper box 3 is thus likewise connected to the evacuation pipe 21 of the rail conveyor truck 4, so that the application of suction by the gripper is no longer necessary and the gripper can be removed. The vacuum in the upper and lower boxes is then maintained through the suction pipe 21 of the rail conveyor 24, until the casting has cooled sufficiently.

For the removal of the casting from the casting box it is merely necessary to connect the suction pipe 21 to the atmosphere. After the adjustment of pressure equilibrium between the atmosphere and the pressure in the interior of the sand, the latter falls together with the casting downwards out of the casting box, which is closed only by a film. For this purpose, an aperture 44 is provided in the rail conveyor truck 4 below the casting box. In the case of heavy castings, the casting box must be supported from underneath. In this case no opening is provided in the rail conveyor truck.

The embodiments of the invention in which an exclusive property or privilege is claimed are defined as follows:

1. In a vacuum molding apparatus having a rail conveyor truck with a vacuum source connection thereon and a casting box for producing castings with the aid of binderless sand, said apparatus being comprised of frame-like upper and lower mold members each having an evacuation chamber, the improvement comprising wherein said evacuation chambers have first coupling means for connection to a vacuum source separate from said vacuum source connection on said rail conveyor truck and first normally closed valve means in said first coupling means and connected in circuit therewith for opening and closing said vacuum source connection, said first valve means being opened in response to the application of a vacuum pressure to said first coupling means, said upper and lower mold members each having second coupling means communicating with said evacuation chambers and second valve means for opening and closing said communication to said evacuation chambers, said second valve means being normally closed when said upper and lower mold members are separated from each other, first actuating means for opening said second valve means in response to a placement of said upper mold member in mating relation on top of said lower mold member to establish communication between said evacuation chambers, and third coupling means communicating with said evacuation chamber in said lower mold member and third valve means for opening and closing said communication to said evacuation chamber, said third valve means being normally closed when said lower mold member is separated from said rail conveyor truck, second actuating means for opening said third valve means in response to a placement of said lower mold member in mating relation on top of said rail conveyor truck and connecting said evacuation chamber in said lower mold member to a vacuum source connection on said rail conveyor truck.

2. The improvement according to claim 1, wherein each of said first, second and third normally closed valve means is closed by a nonreturn valve.

3. The improvement according to claim 1, wherein said second coupling means effects a mating relation between said upper mold member and said lower mold member and is comprised of a pin received in a bore.

4. The improvement according to claim 3, wherein said second coupling means includes a bushing having a seal therearound, said bushing and seal being received in said bore.

5. The improvement according to claim 1, wherein said third coupling means effects a mating relation between said lower mold member and said rail conveyor truck and is comprised of a pin received in a bore.

6. The improvement according to claim 5, wherein said third coupling means includes a bushing having a seal therearound, said bushing and seal being received in said bore.

7. The improvement according to claim 2, wherein said second coupling means effects a mating relation between said upper mold member and said lower mold member and is comprised of a first pin received in a first bore, wherein said third coupling means effects a mating relation between said lower mold member and said rail conveyor truck and is comprised of a second pin received in a second bore, wherein said second and third valve means are disposed in said first and second pins, respectively, and consists of a ball loaded by a spring.

8. The improvement according to claim 7, wherein said first and second bores are disposed in said lower mold member and said first and second pins are disposed in said upper mold member and said rail conveyor truck, respectively.

9. The improvement according to claim 8, wherein said bushings are disposed in line with and opposite one another.

10. The improvement according to claim 8, wherein each of said bushings have a valve seat thereon engaged by a respective valve member of said second and third valve means, said valve members being normally closed by a common spring and each having a push-rod on its outwardly pointing end face for engaging said ball in the corresponding pin and thereby defining said first and second actuating means.

* * * * *